United States Patent [19]

Ralston

[11] Patent Number: 4,485,385

[45] Date of Patent: Nov. 27, 1984

[54] BROADBAND DIAMOND-SHAPED ANTENNA

[75] Inventor: Margarete A. Ralston, Lawrenceville, Ga.

[73] Assignee: RCA Corporation, New York, N.Y.

[21] Appl. No.: 388,688

[22] Filed: Jun. 15, 1982

[51] Int. Cl.[3] ..... H01Q 9/28

[52] U.S. Cl. ..... 343/795

[58] Field of Search ..... 343/795, 794, 793, 809, 343/890, 797, 891

[56] References Cited

U.S. PATENT DOCUMENTS

| | | | |
|---|---|---|---|
| 2,507,225 | 5/1950 | Scheldorf | 343/795 |
| 2,781,513 | 2/1957 | Peterson | 343/795 |
| 2,827,628 | 3/1958 | Swinehart et al. | 343/795 |
| 2,875,438 | 2/1959 | Hings | 343/795 |
| 2,977,597 | 3/1961 | Hamel et al. | 343/795 |
| 3,943,522 | 3/1976 | Ben-Dov | 343/797 |
| 4,180,820 | 12/1979 | Johns | 343/890 |

*Primary Examiner*—Eli Lieberman
*Assistant Examiner*—K. Ohralik
*Attorney, Agent, or Firm*—E. M. Whitacre; W. H. Meise

[57] ABSTRACT

A broadband antenna features a diamond-shaped radiator. The radiator can be bent to form a selected dihedral angle to achieve omnidirectivity when a plurality of antennas having reflector screens are used. Two pairs of radiators can be placed in the turnstile configuration. A pair of shorted tubes can be used as a combination feed means and balun to avoid a separate balun.

8 Claims, 5 Drawing Figures

BROADBAND DIAMOND-SHAPED ANTENNA

BACKGROUND OF THE INVENTION

The present invention relates to antennas, and more particularly to broadband antennas for use in television broadcasting.

Sometimes in television broadcasting, the output signals for several transmitters (each signal for a different channel) are coupled to the same antenna for reasons of economy, space, windloading, etc. Because of the high power involved, this antenna must have a broadband impedance characteristic to avoid excessive reflected voltages and currents in transmission lines which can cause losses and difficulties in matching. Even if only a single transmitter is coupled to the antenna, a broadband antenna allows the manufacturer to reduce the number of models he must offer, thereby leading to economies of scale in production. Further, the antenna should have minimum windloading in order to reduce the structural requirements, and hence cost, of both the antenna itself and the support mast therefor.

A typical prior art antenna is the "batwing" antenna, so called because the width of its elements increases as distance from the feed point increases. Unfortunately, such a configuration has maximum windloading at the ends of the elements resulting in a relatively large bending moment on the support mast and the inner (nearest the feed point) ends of the elements, which is where the element widths are narrowest, and therefore least able to resist the bending moment. Further, the batwing antenna may not have a sufficiently broadband impedance characteristic either to allow several transmitters of different channels to be coupled to it, or, to sufficiently reduce the number of models that must be offered.

It is therefore desirable to provide an antenna that has a broadband impedance characteristic as well as minimum windloading.

SUMMARY OF THE INVENTION

An antenna comprising at least a pair of elements, feed means for applying power to said elements, each of said elements having a progressively narrower width as the distance from said feed means increases.

DESCRIPTION OF THE DRAWINGS

FIG. 1 shows a front view of a first embodiment of the invention; while

FIG. 2 shows a symbolic plan view of a of a second embodiment of the invention; while

DETAILED DESCRIPTION

Figure 1:
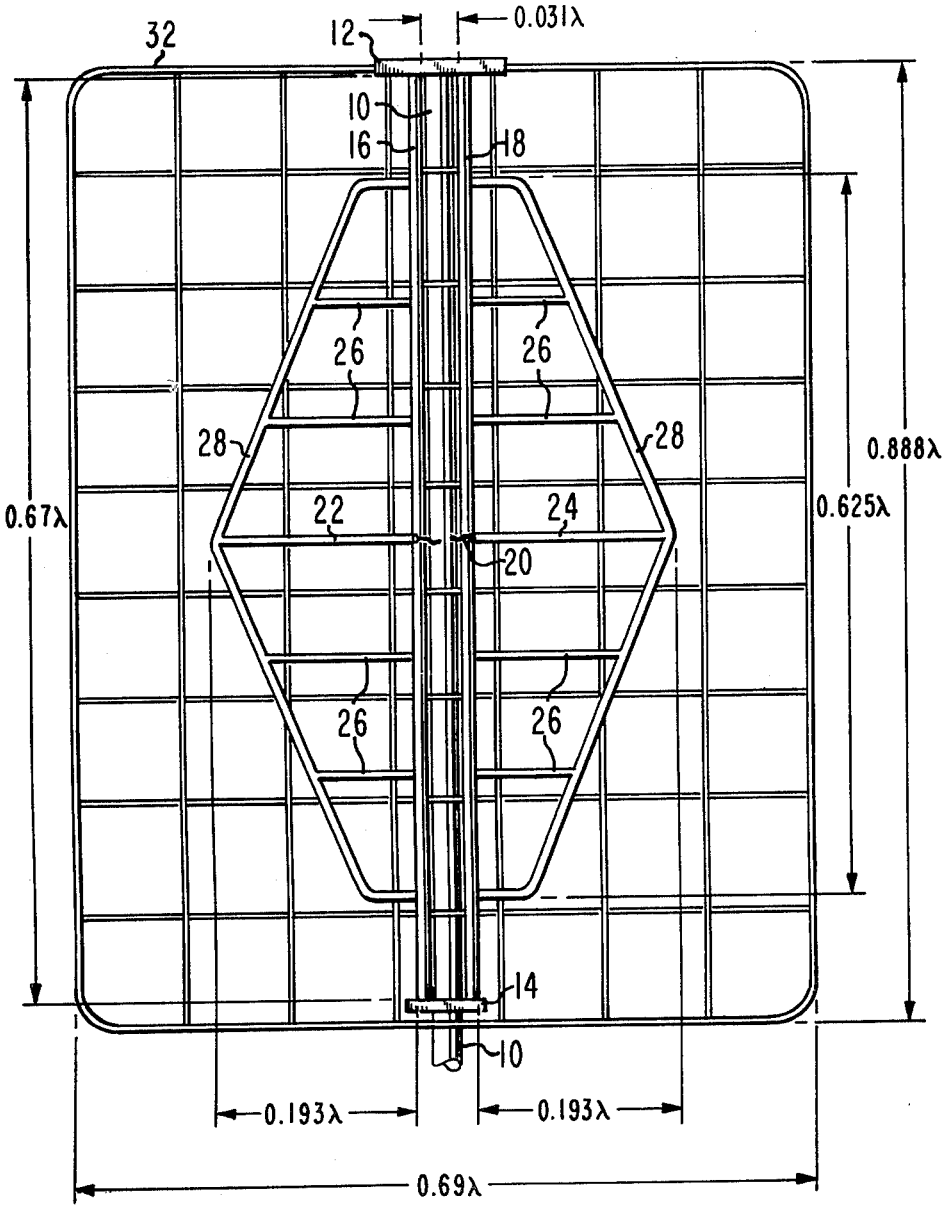

FIG. 1 shows a vertical conducting mast 10 having a lower end that is secured in any of a number of conventional fashions. Secured to mast 10 is a coaxial transmission line (not shown) for conveying power to the antenna. All dimensions given below are in wavelength at a selected design center frequency. Top and bottom conducting horizontal supports 12 and 14 respectively are secured to mast 10 with their facing surfaces spaced about 0.67 wavelengths to provide a 75 ohm match to the transmission line (described below) if no radome is used. If a particular radome is used, this dimension is about 0.653 wavelength due to the dielectric constant thereof. Supports 12 and 14 in turn support and are electrically coupled to the conducting ground plane 32 and vertical left and right support tubes 16 and 18 respectively. Tubes 16 and 18 are parallel and have mutually facing surfaces spaced about 0.031 wavelengths, chosen to provide a broad bandwidth. Feeding is accomplished by a coaxial transmission line (not shown), the outer conductor of which is strapped to mast 10, support 14, and half-way up support tube 16. The outer conductor is electrically coupled to the center of tube 16 and the center conductor is coupled to the center of tube 18 by leads 20, respectively. No balun is required since tubes 16 and 18 are shorted at their top and bottom ends by horizontal supports 12 and 14 respectively, thereby forming shorted stubs, which, at the center feed point provide a high impedance, thereby decoupling the antenna from the feedline.

Figure 1A:
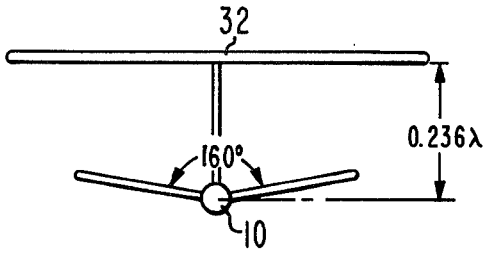
FIG. 1*a* is a symbolic top view thereof.
Figure 3:
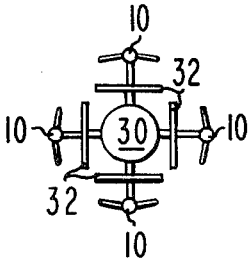
FIG. 3 shows a symbolic top view of a plurality of said first embodiment disposed about a central mast.

Respectively mounted on vertical support tubes 16 and 18 are a pair of diamond-shaped elements 22 and 24 defining a dihedral angle of 160° as shown in FIG. 1*a*, and comprising horizontal portions 26 and outer portions 28. Said angle was chosen so that if four of the antennas of FIGS. 1 and 1*a* are disposed about tower 30 as shown in FIG. 3 and fed in-phase, the pattern is substantially omnidirectional, i.e., the 3 db points of the azimuth patterns of circumferentially adjacent antennas are in the same direction. If a different configuration is used, e.g., three antennas around a mast, then a different angle is required for omnidirectionality.

Outer portions 28 are in the shape of a diamond so that their width tapers from wide to narrow as distance from vertical supports 16 and 18 increases, which configuration increases the bandwidth. The maximum width (height as viewed in FIG. 1) of elements 22 and 24 is about 0.625 wavelengths for broadest bandwidth. The maximum length for each of the elements 22 and 24 is about 0.193 wavelengths for broadest bandwidth.

As shown in FIG. 1*a*, reflector screen 32 is disposed about 0.236 wavelengths behind the apex of elements 22 and 24 to obtain unidirectivity. In a particular embodiment such a screen measured 0.69 wavelengths wide by 0.888 wavelengths high; however, these dimensions are not critical.

A scale model of the above antenna achieved a maximum SWR of 1.151:1 over a frequency range of 450 MHz to 560 MHz. This compares with a maximum SWR of 1.23:1 for a prior art batwing antenna over the same frequency range for the same impedance. This allows a single antenna in accordance with the present invention to be used for the entire range of television channels 7–13 and possibly only two such antennas to cover channels 2–6 with acceptable SWR. A batwing antenna is ordinarily usable over only at most two channels.

Figure 2:
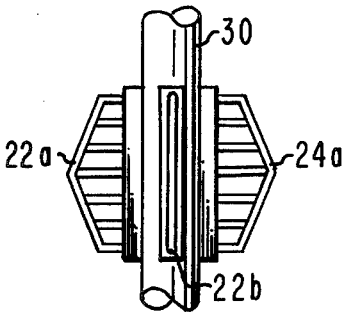
Figure 2A:
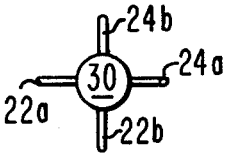
FIG. 2*a* shows a top view thereof.

FIGS. 2 and 2*b* shows a second embodiment of the invention wherein two pairs of diamond-shaped radiators are disposed about a mast 30 in a turnstile (right angle) configuration. One pair 22*a* and 24*a* are coplanar i.e., form a dihedral angle of 180°, while the other pair 22*b* and 24*b* are also coplanar. No screen 32 is used. The dipole formed by elements 22*a* and 24*a* is fed 90° out of phase with the dipole formed by elements 22*b* and 24*b* to achieve a nearly omnidirectional pattern as is known in the art.

If desired a plurality of the configurations as shown in FIG. 2 or 3 can be vertically stacked. Center-to-center spacing of about 0.986 wavelengths has been used. Further, the antenna can be disposed vertically (element 22 above element 24 or vice versa) to achieve vertical polarization. Several such antennas can be arrayed in a circle to provide omnidirectional coverage.

What is claimed is:

1. An antenna, comprising:

planar reflector means;

first and second straight elongated conductive support members spaced from and parallel to said planar reflector means, said first and second support members being mutually parallel;

support member shorting means coupled to said first and second support members for conductively coupling said first and second support members together at first and second locations along said support members;

first and second generally planar conductive dipole elements conductively coupled to and supported by said first and second support members, respectively, at a location centered between said shorting means, each of said first and second planar dipole elements being substantially parallel with said planar reflector means and extending perpendicularly from said support members by distances measured perpendicularly from said support members which are a maximum at a location half-way between said first and second shorting means and which distances are less at locations removed from said half-way location; and feed means electrically coupled to said first and second support members at said location half-way between said first and second shorting means.

2. An antenna according to claim 1, wherein the spacing between said first and second shorting means is about 0.67 wavelengths at a selected design center frequency.

3. An antenna according to claim 2, wherein the spacing of the mutually facing surfaces of said first and second support members is about 0.031 wavelength at said selected design center frequency.

4. An antenna according to claim 1, wherein said first and second dipole elements have a dihedral angle of about 160° therebetween.

5. An antenna according to claim 2, wherein said first and second dipole elements have a dihedral angle of about 160° therebetween.

6. An antenna, comprising:

first and second elongated straight mutually parallel conductive support means lying in a first plane;

first and second conductive shorting means coupling said first and second support means together at first and second locations, respectively, which first and second locations are equidistant from a central transverse second plane which is transverse to the longitudinal direction of said elongated support means;

feed means coupled to said first and second support means at said transverse second plane; and planar radiating means electrically coupled to and supported by said second support means, said planar radiating means lying in said first plane and extending away from said first and second support means, said planar radiating means extending from said second support means by distances measured perpendicularly from said second support means, which distances differ from location to location along the length of said support means, said distances being a maximum at the location of said transverse second plane and being less than said maximum and decreasing linearly from said maximum distance at locations along the length of said support means removed from said transverse second plane.

7. An antenna according to claim 6 wherein said first and second elongated mutually parallel conductive support means comprise equal-diameter tubes.

8. An antenna according to claim 7 further comprising a second planar radiating means electrically coupled to and supported by said first support means, said second planar radiating means being substantially coplanar with said first-mentioned radiating means, said antenna further having a plane of symmetry lying between said first and second elongated mutually parallel conductive support means.

* * * * *